US010460554B2

(12) United States Patent
Stanford et al.

(10) Patent No.: US 10,460,554 B2
(45) Date of Patent: Oct. 29, 2019

(54) PLAYER ISOLATION, TOUCH-SENSITIVE ELECTRONIC GAMING TABLE

(71) Applicant: Jackpot Digital Inc., Vancouver (CA)

(72) Inventors: Michael Stanford, Charlotte, NC (US); Kendal Boyd Ferner, Charlotte, NC (US)

(73) Assignee: Jackpot Digital Inc. (CA)

( * ) Notice: Subject to any disclaimer, the term of this patent is extended or adjusted under 35 U.S.C. 154(b) by 1131 days.

(21) Appl. No.: 14/488,108

(22) Filed: Sep. 16, 2014

(65) Prior Publication Data

US 2016/0078709 A1 Mar. 17, 2016
US 2017/0243432 A9 Aug. 24, 2017

Related U.S. Application Data

(60) Provisional application No. 61/878,247, filed on Sep. 16, 2013.

(51) Int. Cl.
*G07F 17/32* (2006.01)

(52) U.S. Cl.
CPC ..... *G07F 17/322* (2013.01); *G07F 17/3209* (2013.01); *G07F 17/3211* (2013.01)

(58) Field of Classification Search
CPC . G07F 17/322; G07F 17/3209; G07F 17/3211
USPC ..... 463/37
See application file for complete search history.

(56) References Cited

U.S. PATENT DOCUMENTS 4,614,342 A * 9/1986 Takashima ..... A63F 13/12 463/11
5,839,960 A * 11/1998 Parra ..... A63F 3/00157 463/41
8,333,652 B2 * 12/2012 Nguyen ..... G07F 17/3218 463/22
2005/0049049 A1 * 3/2005 Griswold ..... G07F 17/3206 463/46
2005/0178074 A1 * 8/2005 Kerosetz ..... A47F 9/02 52/36.1
2006/0055114 A1 * 3/2006 White ..... A63F 3/00 273/309
2006/0058084 A1 * 3/2006 Crawford, III ..... G07F 17/32 463/11
2006/0189365 A1 * 8/2006 Crawford, III ..... G07F 17/32 463/13
2008/0076581 A1 * 3/2008 Mattice ..... G06F 3/041 463/46
2008/0113772 A1 * 5/2008 Burrill ..... G07F 17/32 463/25

(Continued)

*Primary Examiner* — Omkar A Deodhar
*Assistant Examiner* — Shauna-Kay Hall

(57) ABSTRACT

A gaming table having multiple player input positions on a playing surface of the gaming table can be constructed in a manner that provides individual player sensitive touchscreen areas and both simplifies the methods of construction use and repair of the table, but also reduces its initial cost significantly. The table may, for example, have: a continuous, flat, transparent gaming table surface layer; multiple, independent touchscreen plates under the transparent gaming table surface layer; each of the multiple, independent touchscreen plates having a communication link to a game server; and at least some or all of the multiple, independent touchscreen plates being physically separated from other independent plates.

10 Claims, 9 Drawing Sheets

(56) References Cited

U.S. PATENT DOCUMENTS

| | | | | |
|---|---|---|---|---|
| 2009/0054159 | A1* | 2/2009 | Gadda | G07F 17/32 463/46 |
| 2010/0222148 | A1* | 9/2010 | Kuhn | A63F 13/08 463/46 |
| 2013/0079084 | A1* | 3/2013 | Sparago | A63F 1/00 463/11 |
| 2013/0079086 | A1* | 3/2013 | Sparago | A63F 1/00 463/12 |
| 2013/0190082 | A1* | 7/2013 | van Linden | G07F 17/322 463/31 |
| 2014/0274252 | A1* | 9/2014 | Chun | G07F 17/3225 463/11 |

* cited by examiner

PRIOR ART

PLAYER ISOLATION, TOUCH-SENSITIVE ELECTRONIC GAMING TABLE

CROSS-REFERENCE TO RELATED APPLICATIONS

The Applicants claim the benefit, under 35 U.S.C. § 119(e), of U.S. Provisional Patent Application No. 61/878,247 filed Sep. 16, 2013, and entitled "Player Isolation, Touch-Sensitive Electronic Gaming Table. The entire content of this provisional application is incorporated herein by this reference.

COPYRIGHT NOTICE

A portion of the disclosure of this patent document contains material which is subject to copyright protection. The copyright owner has no objection to the facsimile reproduction of the patent document or the patent disclosure as it appears in the U.S. Patent and Trademark Office patent files or records but otherwise reserves all rights of copyright whatsoever.

BACKGROUND OF THE INVENTION

1. Field of the Invention

This invention relates to wagering games, gaming tables, gaming systems, and associated methods. More particularly, the inventions relates to electronic gaming tables, systems, and related methods which provide a set of player stations with user interfaces and display screens for participating in a table game.

2. Background of the Related Art

Table games have been played among players in social settings and in casinos for many years. Table games have included dice games, wheel games (e.g., candy wheel games, roulette, etc.), and playing card games. Playing card games have been the most popular of the table games, but they have always had to address security problems because of the many different gaming objects on a table at one time (cards and chips). Extensive security efforts have been developed over the years to prevent spurious manipulation of the gaming elements in table games.

Shuffling machines were developed to prevent lack of randomness that occurred in the manual shuffling of cards. Dealing shoes were developed so that only top cards could be dealt (rather than seconds or bottom cards fraudulently delivered by a dealer. Varied color chips, chips with RFID technology, video cameras, the eye-in-the-sky and other surveillance technology have been put in place to create obstacles against fraud and collusion at gaming tables.

In the late 1990's, more and more electronic technology was introduced into gaming technology. An objective of the new electronics was to reduce the potential for fraud in gaming as well as to speed up play of the game by eliminating the need for physical gaming objects to be manually placed about the table.

Touch screen displays and button decks have been previously introduced in table games to eliminate physical game components, such as cards and chips. Through the use of touch screen displays, users can perform player or dealer operations through simple or multi-touch gestures. Some touchscreens can also detect and respond to objects such as a stylus or ordinary or specially coated gloves. Various touch screens provide for response to pinching or expanding finger distance while touching the screen to resize the displayed images.

Historically, the touchscreen sensor and its accompanying controller-based firmware have been made available by a wide array of after-market system integrators, and not by display, chip, or motherboard manufacturers. Display manufacturers and chip manufacturers worldwide have acknowledged the trend toward acceptance of touchscreens as a highly desirable user interface component and have begun to integrate touchscreens into the fundamental design of their products.

Several ways have been previously developed to manufacture touchscreens. The key goals are to recognize one or more fingers touching a display, correctly interpret the command that the touch or gesture represents, and communicate the command to the appropriate application.

One of the more popular touchscreen designs use a capacitive or resistive approach. For a capacitive-based touchscreen, there are typically four layers: 1) a top polyester coated with a transparent metallic conductive coating on the bottom (this type of layer will be referred to herein as the touchscreen plate, distinguishing it from the entire touchscreen system or panel, which would include layers 2, 3 and 4 below); 2) an adhesive spacer; 3) a glass layer coated with a transparent metallic conductive coating on the top; and 4) an adhesive layer on the backside of the glass for mounting. When a user touches the capacitive-based touchscreen surface, the system records the change in the electrical current that flows through the display. Dispersive-signal technology which Minnesota Mining and Manufacturing Co. (3M) created in 2002, measures the piezoelectric effect, the voltage generated when mechanical force is applied to a material—that occurs chemically when a strengthened glass substrate is touched.

In addition to the capacitive-based touchscreen designs, there are infrared-based touchscreens. In one type of infrared-based touchscreens, an array of sensors detects a finger touching or almost touching the display, thereby interrupting light beams projected over the screen. In another type of infrared-based touchscreens, bottom-mounted infrared cameras record screen touches.

In each touchscreen design type, the processing system associated with the touchscreen, determines the intended command based on the controls showing on the screen at the time and the location of the touch. There continues to be a need for improved electronic gaming table designs with greater configurability, improved maintainability, and greater flexibility in receiving simultaneous player inputs from multiple player input stations.

SUMMARY OF THE INVENTION

In accordance with one or more embodiments of the present invention, an electronic gaming table having multiple player input positions includes a substantially homogeneous gaming table surface layer, such as a flat screen display with multiple, independent touchscreen plate assemblies disposed underneath. Each of the independent touchscreen plate assemblies are associated with a respective player input position and are communicatively connected to a game processor, such as a local or remote game server programmed to operate one or more table games (e.g. blackjack, poker, baccarat, etc.).

In accordance with one or more embodiments of the present invention, the electronic gaming table includes a pedestal upon which the gaming table surface layer and touchscreen plates rest. The pedestal may include a local game server that is connected to each of the player input positions and which may be further connected to one or more servers, such as to facilitate table game management, financial accounting, and/or financial transactions.

In accordance with one or more embodiments of the present invention, at least two, and preferably all, of the multiple, independent touchscreen plates are physically separated, such as with a gap between plates to prevent stray signals from one player input position to be transmitted onto another player input position.

In accordance with one or more embodiments of the present invention, the surface table layer may further include a dealer input position with an associated independent touchscreen plate assembly and communicatively connected to the game processor. The dealer input position may also connect to one or more servers and provide hosting services for the table games, either through automated programming or through a live dealer.

These and other features and advantages of the invention will be apparent from the following detailed description, considered together with the accompanying drawings.

DETAILED DESCRIPTION OF THE INVENTION

Figure 1:
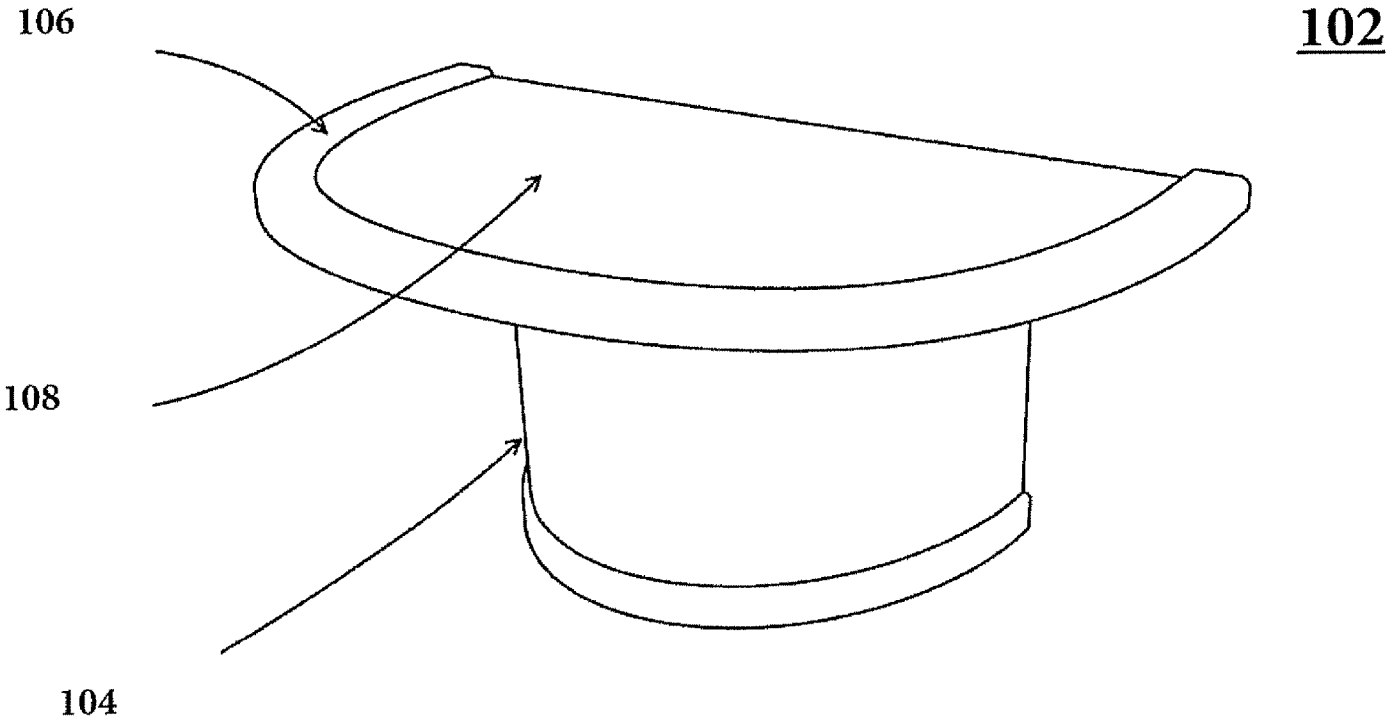
FIG. 1 illustrates a perspective view of a typical gaming table. (PRIOR ART)

Referring to FIG. 1, a conventional gaming table 102 is shown. Gaming table 102 typically includes a base 104, rim 106 and table top 108 for use as a table game playing surface. Typical table games include card games (e.g. blackjack, poker, baccarat), dice games (e.g. craps), and wheel games (e.g. roulette). Gaming table 104 may include one or more multiple player positions situated about table top 108 or rim 106. Typically, the players are situated around the semi-circle portion of table top 108 at respective player positions and a dealer is situated at a dealer position located about the radial area along the longitudinal portion of table top 108.

Figure 2:
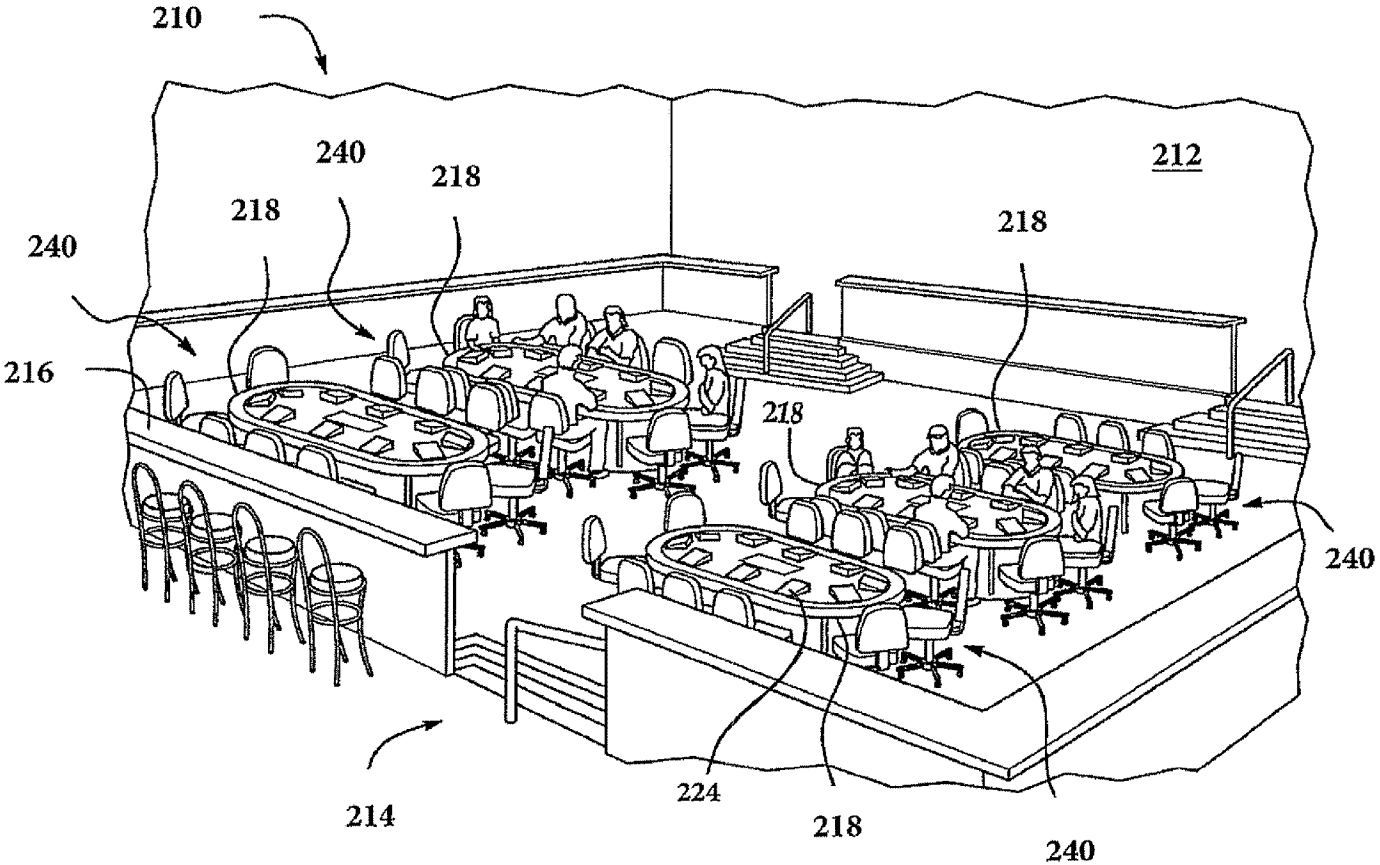
FIG. 2 is a diagrammatic illustration of a system for providing an electronic poker game on one or more electronic poker tables, according to an embodiment of the present invention.

Referring to FIG. 2, example table gaming system 210 is shown including a plurality of electronic gaming tables 218 which may be network connected to a master gaming server (not shown) in accordance with the present invention. Table gaming system 210 is typically designed to be situated in a gaming environment 212, such as a casino table game area or card room 214. Table gaming system 210 may include as few as one and as many electronic gaming tables 218 depending upon the casino or gaming room operator. Typically, such gaming environments 212 are a specialized or designated area within a casino which has been cordoned off by, for example, as with railing 216. While the above refers to one possible implementation or location in which the system 210 may be used, the present invention is not limited to any such location or implementation. Other details of the system may be found in U.S. patent application Ser. Nos. 11/052,360, 11/073,775, 11/152,359, 11/073,774, 11/073,518, 11/074,038, 11/073,534, 11/073,804, 11/052,131, 11/073,805, 11/052,391, 11/052,129, 11/074,379, 11/052,130, 11/073,533, 11/073,516, 11/073,916, 11/074,380, 11/052,343, 11/173,511 and 11/073,035, which are hereby incorporated by reference.

In the illustrated embodiment, table gaming system 210 utilizes electronic chips and electronic playing cards at electronic gaming table 218 to provide an automated table game for play by one or more players. In one aspect of the present invention, each electronic gaming table 218 may be programmed to manage operation of a respective table game including all dealer functions without a live dealer.

Table gaming system 210 may be designed or programmed to play one or more variations or versions of table game including blackjack, poker, baccarat, roulette, craps, and/or variations thereof at one or more electronic gaming table 218. However, for the purposes of discussion, the system 210 will be described as adapted for use in implementing the version of poker known as, Texas Hold'em.

Table gaming system 210 and electronic gaming tables 218, although electronic, are designed to convey and retain the overall sense and ambience of a standard table game section and/or poker room with non-electronic gaming tables. Each electronic poker table 218 is surrounded by a number of chairs 240. The number of chairs 240 may generally equal the number of electronic player interaction areas 224 on electronic gaming table 218.

Table gaming system 210 may be designed and/or programmed to assign players to a chair 240, provide electronic chips, accept wagers, and assign a pot or award to the winning player through the use of a master table gaming server and/or a dedicated table game server respectively associated with each electronic gaming table 218. The master table gaming server or dedicated table game servers may be programmed to shuffle a set of electronic playing cards and deal cards to each participating player designated area and player common area as may be displayed on the playing surface. Each table gaming server may also be programmed to manage wagering, folding, calling by the players and may restrict such, based on whose turn it is.

Each electronic gaming table 218 in table gaming system 210 may be networked and connected to one or more servers (see below). The servers may be programmed to implement and facilitate: player tracking, ticket in ticket out (cashless) wagering, assigning players to a seat at a particular gaming table, tournament play, table set-up (including turning the tables on and off and modifying table parameters), progressive jackpots, accounting, and other casino functions.

Figure 3A:
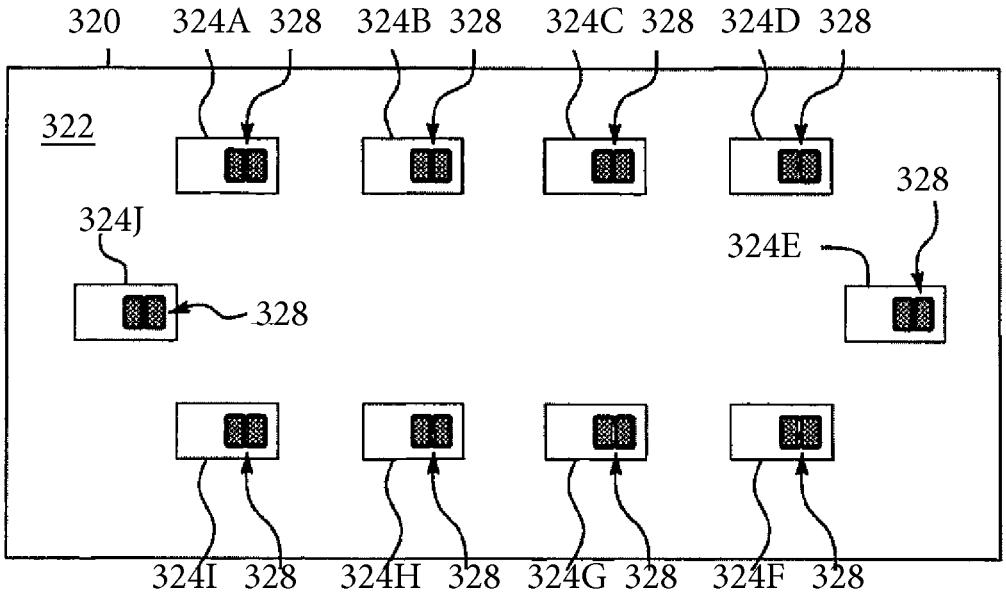
FIG. 3A is a simplified diagram of a table top of the electronic poker tables of FIG. 1, according to an embodiment of the present invention.
Figure 3B:
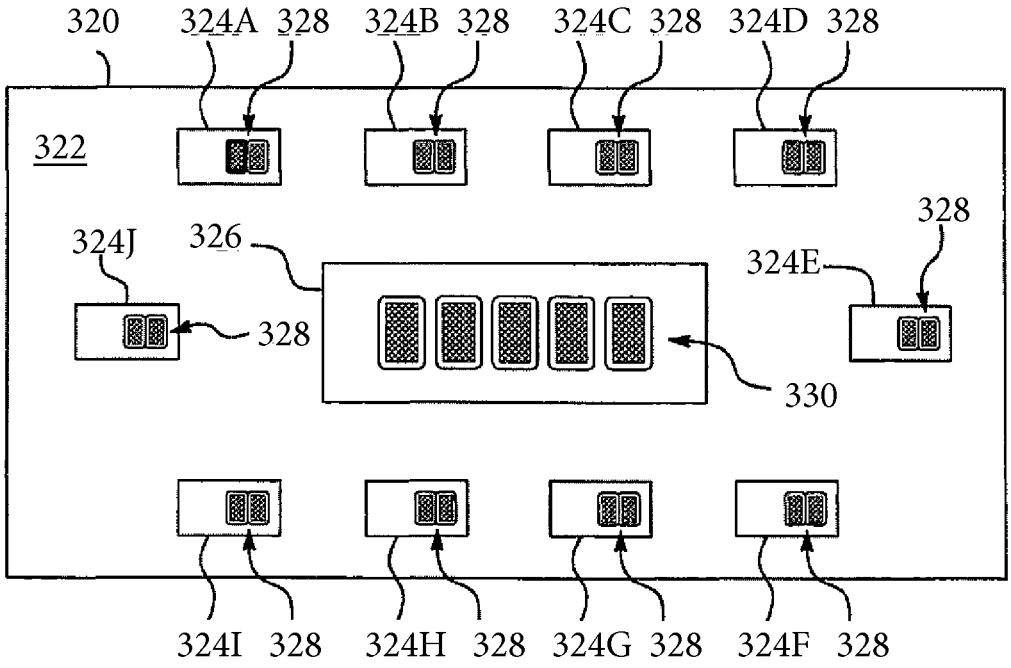
FIG. 3B is a simplified diagram of a table top of the electronic poker tables of FIG. 1, according to another embodiment of the present invention.

Referring to FIG. 3A and FIG. 3B, example table top 320 of electronic gaming tables 218 is shown to include playing surface 322. Two table game layouts are shown displayed on playing surface 322 including a plurality of electronic player interaction areas 224 (EPIAs 324A-J). The table game layouts are shown as examples of configurations that may be implemented by design and/or programming executed by respective table game and/or master table gaming servers. Depending upon the configuration, playing surface 322 may be shown to display central or common display area (CDA) 326 as shown in FIG. 3B. Each electronic player interaction area 324A-J may display game information to respective players and include a player user interface (see below) enabling interaction or input from the player. Central or common display area 326 may display information to all of the players.

For example, table gaming system 210 may be configured such that one or more electronic gaming tables 218 may display and operate the version of poker known as Texas Hold'em. In Texas Hold'em, each player is dealt a number of cards, e.g., two cards, face down. These are known as a player's "hole" cards 328. A number of cards, e.g., three or five, are dealt face-up and displayed in common display area 326. These are known as the common cards 330. A player's hand, thus, comprises the player's hole cards 328 and the common cards 330. At the end of each hand, of the remaining players, whichever player's hand makes the highest poker hand is the winner of that round or hand of poker.

Hole cards 328 may be displayed face-down on the respective electronic player interaction area 324 and the common cards are displayed face-up in central display area 326. Hole cards 328 are displayed at a first predetermined ratio and common cards 330 are displayed at a second predetermined ratio. The first and second predetermined ratios may be expressed as a ratio of a standard size playing card or a predetermined default size. In one embodiment, the first and second ratios are the same. In another embodiment, the first and second ratios are different. For example, the first and second ratios may be defined such that common cards 330 may be displayed larger than hole cards 328.

Playing surface 322 may be implemented as a single display surface substantially corresponding to the surface area of table top 320 in accordance with the present invention. Electronic player interaction areas 324A-J and central display area 326 may be set apart from the rest of playing surface 322 by virtual or physical borders; and each area may include a touchscreen surface which may be active or inactive depending upon game programming.

A gaming table server may be housed beneath table top 320 or remotely and include game programming executable to manage play of the table game and data associated with each electronic player interaction area 324A-J. The table game server may incorporate a fully-functional computer. The computer includes a processor capable of running an operating system, such as Microsoft Windows CE, XP, 7, etc. produced by Microsoft Corporation of Redmond, Wash. Electronic gaming table 218 may include a card reader associated with each electronic player interaction areas 324A-J for reading respective player ID cards (not shown) and transmitting the player information to the gaming table server which in turn may retain the player information and manage it together with playing data associated with the respective player interaction area.

The areas of the display around electronic player interaction areas 324 and the central display area 26 may be used to simulate the table top of a standard poker table, e.g., an image of material, such as green felt, may be displayed. Alternatively or additionally, portions of table top 20 may be covered in a material such as felt, or more specifically, green, blue, or red felt that typically covers table tops and some of the material may cover portions of the display surface which are not used or needed for display of the table game. Logos, game information, or other information may be printed on the non-display portions of table top 320; while logos, game information, other information, advertisements, announcements, pictures, videos, or other information may be displayed, rotated, cycled, or displayed for a limited period of time on display portions of playing surface 322.

Figure 4A:
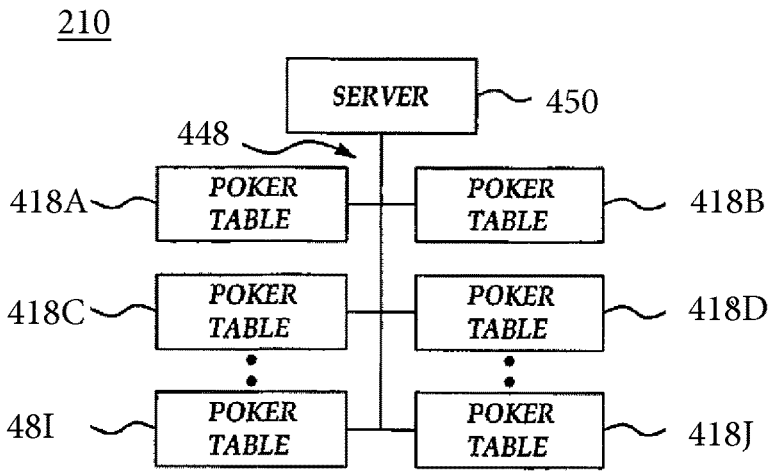
FIG. 4A is a block diagram of the system of FIG. 1, according to an embodiment of the present invention.
Figure 4B:
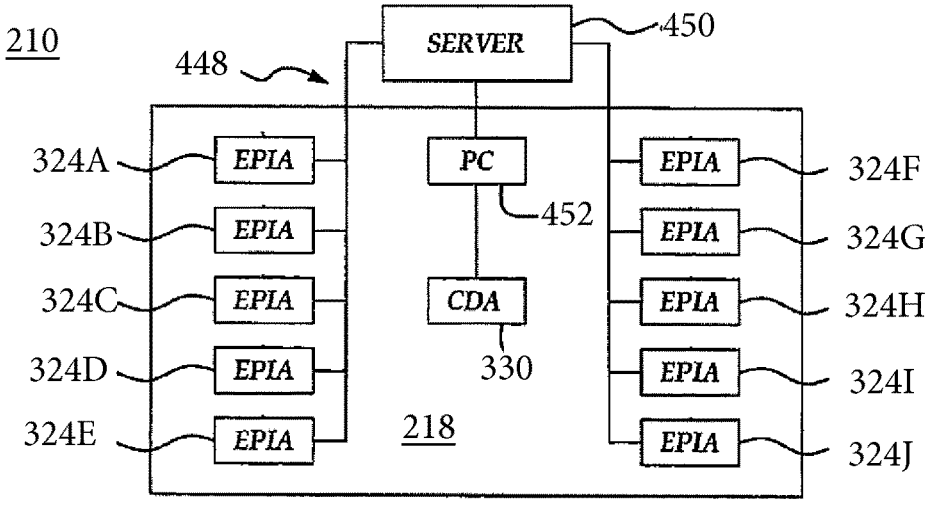
FIG. 4B is a second block diagram of the system of FIG. 1, including the element of an electronic poker table, according to an embodiment of the present invention.

Referring to FIGS. 4A and 4B, as discussed above table gaming system 210 may include one or more electronic gaming tables 218 (e.g. electronic gaming tables configured for poker 418A-J). Electronic gaming tables 218 may be networked together using, e.g., an Ethernet network 448. One or more servers 450 may be used to provide functionality for table gaming system 210. For example, one or more servers 450 may be programmed to implement various functions, including, but not limited to: starting and stopping one or more of electronic gaming tables 218 during play of a game, tracking game and player information, managing cashless wagering, defining and modifying table parameters, including, turning electronic gaming tables 218 on and off, selecting the game and setting the game parameters being played at each electronic gaming table 218, setting wager parameters, etc., defining and managing jackpots, including the house percentage, i.e., the rake, defining and managing progressive jackpots, establishing and managing a queue for players and assigning players to chairs 240 and/or specific tables from the queue, and establishing and managing tournament play, including assigning player chairs, collapsing tables, etc.

With particular reference to FIG. 4B, example electronic gaming table 218 (e.g. one of 418A-J of table gaming system 210 is shown including ten electronic player interaction areas 324A-J and central display area (CDA) 330 which are implemented gaming table server 452. Gaming table server 52 is connected to the master gaming server 450 through the network 448. In one embodiment, the master gaming server 450 operates the table games, manages the player information, and manages all the functions on each electronic gaming table 218. In another embodiment, each table game or portions thereof may be executed or run by the respective table game server 452.

Figure 5:
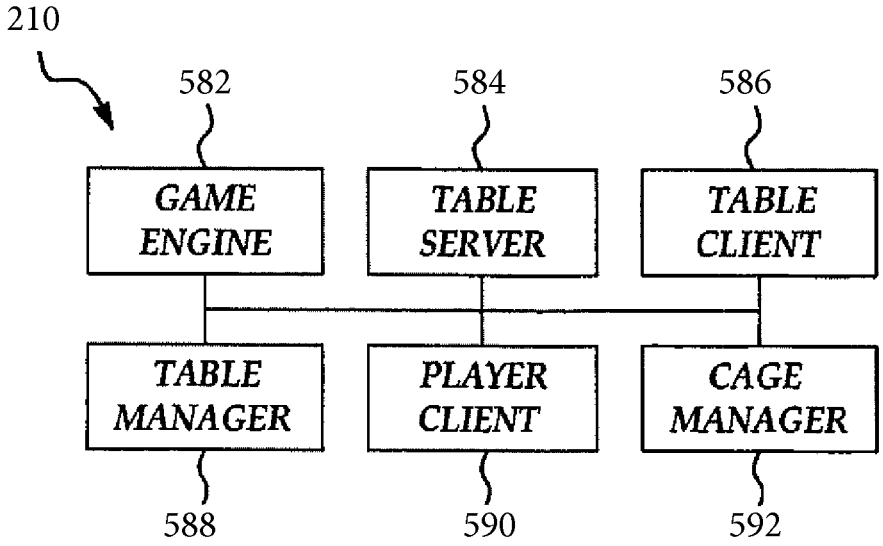
FIG. 5 is a block diagram of software components of the system of the present invention.

Referring to FIG. 5, from a software perspective table gaming system 210 may be implemented using six program groups: a game engine 582, a table server 584, a table client 586, a player client 588, a table manager 590, and a cage manager 592. Table server 584 implements the network communication, control and authentication as well as inter-table functions (seat reservations, multi-table tournaments). The game engine 582 administers the electronic poker game and is responsible for all game functions, e.g., electronic playing card deck generation, dealing, betting, determining winners and awarding pots. The table client 586 is the graphical control for the central display area 326. The player client 90 implements the user interface for the electronic player interaction areas 224 and the logic for capturing player input and communication from the player input to the table client server. The table manager 588 contains the user interface for setting user, network, and game parameters, for starting, pausing, and stopping games, and for monitoring game activity and responding to system or user generated alerts. The cage manager 592 provides the ability to create and fund player accounts and to create the Player Cards.

Figure 6:
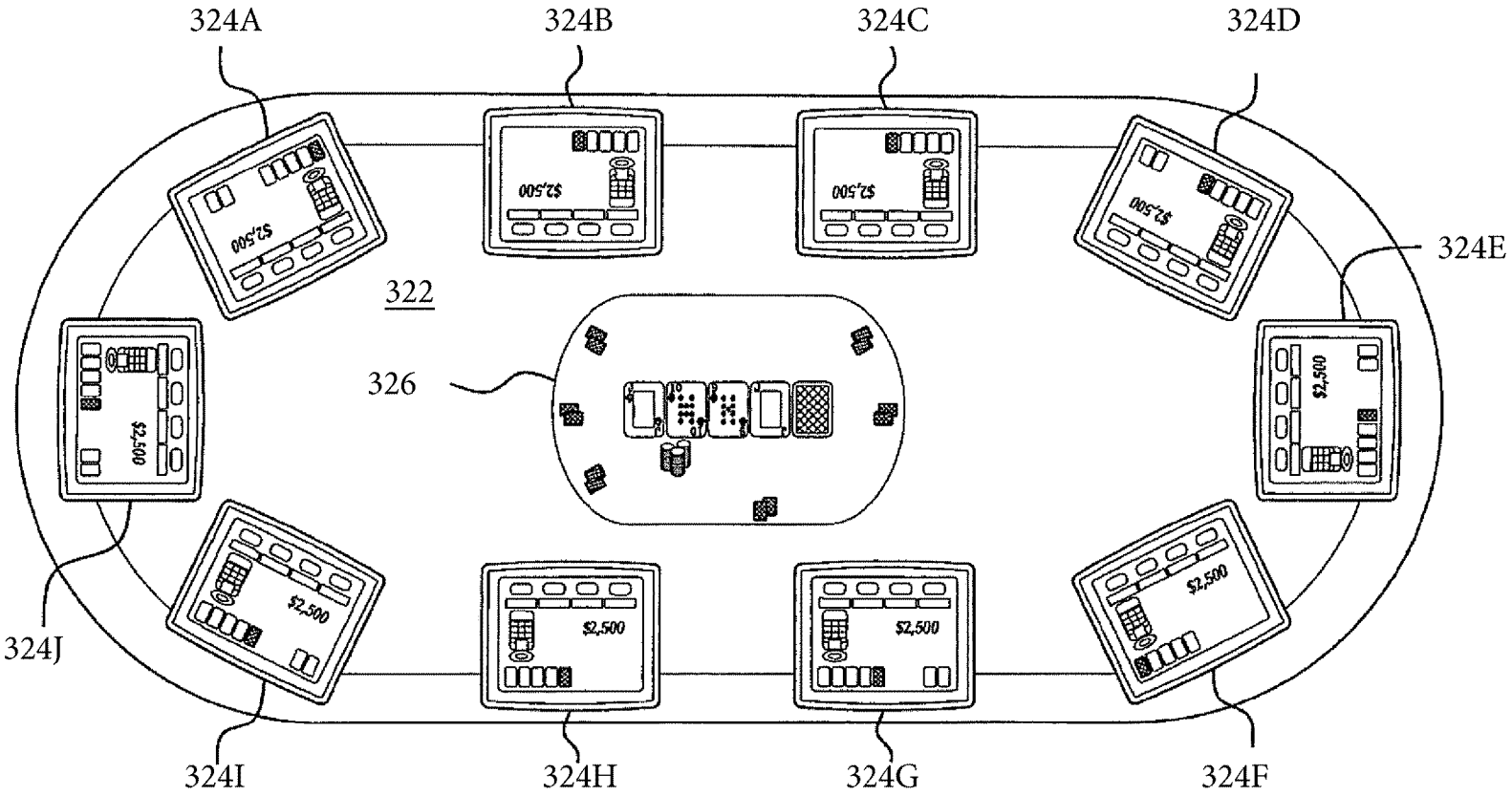
FIG. 6 is a top view of the electronic poker table of FIG. 2 according to the present invention.

Referring to FIG. 6, an upper view is shown of gaming surface 322 including multiple player interaction areas 324 (EPIAs 324A-J) and central display area 326.

Figure 7:
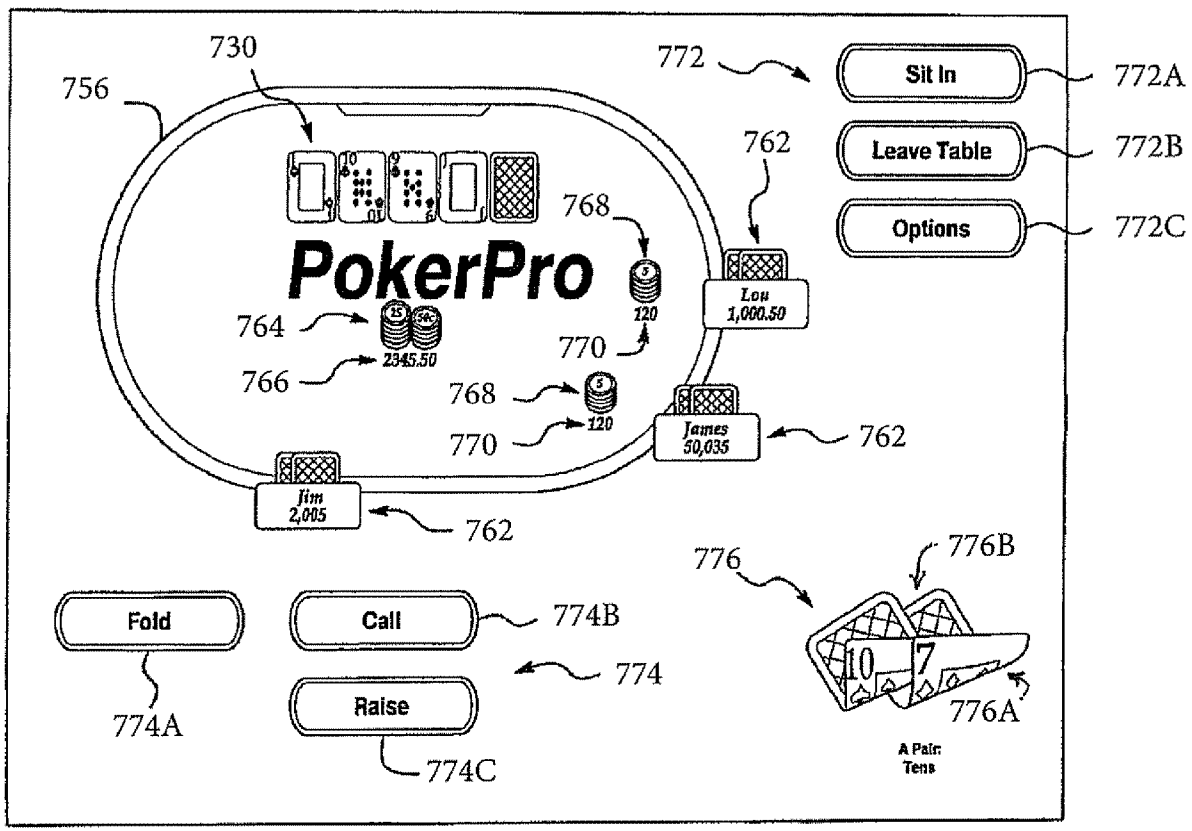
FIG. 7 is a representation of a screen shot displayed on a player interaction area according to the present invention.

Referring to FIG. 7, example player interface display 754 is shown as may be displayed within player interaction area 224 of gaming surface 322 in accordance with the invention. Player interaction areas 224 may include graphical player interface displays 754 as shown, or may take other forms, such as a simple textual format player interface display (not shown). In one embodiment, electronic player interaction areas 224 provide the player with the option of choosing between several types of player interface displays 754, such as a graphical representation of an electronic gaming table 756 or the text interface.

In the case of a graphical representation of electronic gaming table 756, each player in the poker game may be represented by a user graphic or icon 762, which may list their names as well as their chip totals. The pot of the current hand may be represented in the center of the poker table 756 by stack(s) of chips 764 and/or a number 766 representing the value of the current pot. Each player's contribution to the pot may be represented by stack(s) of chips 768 and/or a number 770 adjacent their user graphic 762.

Player interface display 754 may also include a series of player option buttons 772 and a series of game buttons 774. The player option buttons 772 may include, for example, a sit in button 772A, a leave table button 772B, and an options button 772C. Generally, only one of the sit in button 772A and the leave table button 772B would be active at any time. The options button 772C may allow the player to access an option menu or screen (not shown) which may allow the player to modify certain parameters of the player interface display 754, such as, for example, to choose between different formats of the player interface display 754. The series of game buttons 774 allow the player to signal their game play decisions to the system 210 during the play of the game. The game buttons 774 may include a fold button 774A, a call button 774B and a raise button 774C. These typically would only be active when it is a player's turn in the poker game. In one embodiment, the buttons 772 are implemented on player interaction areas 224. In an alternative embodiment, the buttons 772 are embodied in electromechanical switches or buttons (not shown).

Player interface display 754 may also include the community cards 330. Other information which may be displayed on the player interface includes, but is not limited to indicator of the player whose turn it is, a total of chips for each player, any cards of the other players which are face-up, and/or messages to the player, such as advertising.

In another aspect of the present invention, player interface display 754 includes a graphical representation of one or more of electronic playing cards 776. Each electronic playing card 776 has a front side 776A and a back side 776B. The back side 776B of each card has an identical pattern or image such that the cards cannot be told apart when viewing the back side 776B. The electronic playing card 776 is typically one of a set or deck of standard playing cards. The deck may be a standard deck of fifty-two cards, each card having a value. The value being two components: the first component being one of a two through ACE and the second component being one of four suits (hearts, diamonds, clubs, spades). The value of each card is indicated on the front side 776A of each playing card 776. The image displayed on the back side 776B of the playing cards may be a logo, a random image (chosen from a set of predetermined images), or may be advertising directed at the player. The image may include a video. In one embodiment, the image displayed on the back side 776B of the playing cards may be cycled through a set of predetermined images. The image may be selectable by a user, who may be the player or an employee of the operator of the casino.

In one embodiment, the electronic playing card or cards 776 are a player's hole card(s) in an electronic poker game. However, the electronic playing cards 776 may be used in any sort of electronic card game in which it is desirable to controllably display/hide the player's cards. Thus, while the present invention may be described below in the context of an electronic poker game (and more specifically, with respect to a player's hole cards in a Hold'em style poker game), the present invention is not limited to such a card game.

In a playing card game with physical cards, in which the player's cards are dealt "face-down" and not revealed to any other player, the player may look at their cards, while attempting to keep the cards secret from the other players in several ways. For example, the player may lift the cards close to their bodies, spread them out, and shield them with their hands, so only the player can see the front side of their cards. Or the player may leave the cards face down on the table and lift one side or corner revealing at least a portion of the front side, while shielding the cards with their hands. Similarly, with electronic table games 218, cards may be dealt face down and may be moved around by a player and may be viewed such as by tapping a corner of a card.

A controller, which is either, gaming table server 452 or master gaming server 450 or a combination thereof, controls player interface display 754, i.e., controls the information components of the player interface display 754 shown on electronic player interaction areas 224, detects touches on the touch screen display area associated with each player interface display 754 and interprets the touches as trigger or touch events (see below). The controller may control the display or obscuring (hiding) of the player's hole electronic playing card(s) such that the player may controllably display and view the cards, while maintaining them secret from the other players. As if the player was playing with physical playing cards, the player, thus, has the opportunity to shield their cards with their hand or hands prior to them being revealed. A system and method for controllably displaying/obscuring the player's hole electronic playing card(s) is disclosed in U.S. patent application Ser. No. 10/939,772, filed Sep. 13, 2004, which is hereby incorporated by reference.

Once a player is assigned to a particular chair 240 at electronic gaming table 218, the associated EPIA 224 may set as inactive or locked and may indicate the assigned player's name. Once the EPIA 224 is locked, the assigned player may be required to login to the EPIA 224. Once the player logs-in, the EPIA 224 becomes active and the player interface display 754 is shown. Also, since the EPIA 224 is active, the player may enter or sit-in on the game being played at electronic gaming table 218 or adjust/modify any available options by actuating the options button 772C.

In one embodiment, the player may log-in to the table gaming system 210 using a player tracking card. The player inserts or swipes their player tracking card through the card reader (not shown); or, the player may set the card onto an area of EPIA 224 where the card may be read by a sensor. EPIA 224 may also require entry of a PIN into an attached keypad or keypad implemented on the touch-screen display. Alternatively or in addition, the player may log-in using a biometric parameter, such as a fingerprint, sensed by a sensor and a RFID card or chip. Once a player's identity has been established, however, the player can access a player account, purchase chips using an account balance. Additionally, information regarding the player's play at the table may be tracked and recorded to the player's account.

EPIA 224 may include a sound generation device which is used to generate sounds audible to the player assigned to the EPIA 224. The sound generation device may be implemented with an earpiece or headphones or one or more speakers. Generated sounds may be categorized as system sound or player sounds. System sounds include sounds which are intended or suitable to be heard by everyone, including other players and non-players and may include a simulated dealer voice. Player sounds include sounds which are intended to be heard, but not necessarily only, by the player. Example, system sounds may include sounds imitating the shuffling of cards, the dealing of cards, chips thrown into the pot, or sounds related to the winning of the jackpot. Player sounds may include a reminder or indication of a player's turn or if the game is timed, an indication of the time remaining or that time is running out. Player exclusive sounds are sounds that can or should only be heard by the player and may indicate an audible signal indicating the player's hole cards or the highest hand of the player or a winning percentage associated with the player's hand.

Once the player decides to leave electronic gaming table 218, any remaining chips they have, may be instantly converted back into dollars and stored in their player account and/or a new ticket may be generated when the player selects leave table button 772B.

Each EPIA 224 may provide an indication of whose turn it is to act. If it is the player's turn who is assigned to an EPIA 224, then the EPIA 224 may provide an appropriate signal, such as an icon, either next to their name or anywhere on the EPIA 224, a sound such as a beep or musical tones, and/or a voice message. If it is another player's turn, the EPIA 224 may indicate whose turn it is by an icon and/or flashing text, e.g., adjacent the player's name.

EPIA 224 includes a set of player option buttons 772 which allow the player to take an appropriate action, such as bet, fold, or call, during their turn. In one embodiment, the EPIA 224 only activates those buttons 772 which are appropriate, given the rules of the game being played, during the current turn. For example, if the maximum number of raises for a particular game has already been made, then the wager or raise button would be inactive. Additionally, all of the buttons 772 will be inactive when it is not the player's turn.

Typically displays, such as LCD or Plasma monitors are rectangular in form. The overlay may be integral with table top 320 and may include a cut out. The overlay covers the outer edge of the display. Only the portion of the display inside the cut-out is visible. In the illustrated embodiment, the cut out has a shape, such as an oval shape, which is similar to the shape of the table.

Central display area 326 may provide an indication of whose turn it is to act. In one embodiment, the central display area 326 may provide an appropriate signal, such an icon, e.g., an arrow or other symbol, a sound such as a beep or musical tones, and/or a voice message. This indication of a player's turn may be in addition to the indication on the EPIA 224.

During a poker hand, even at a standard poker table with a human dealer, one of the players is designated as the "dealer", for the purposes of the order in which the playing cards are dealt and in which wagers are made. In one aspect of the present invention, the central display area 326 may provide an indication of which player is designated the "dealer" for the current hand. In one embodiment, the central display area 326 may provide an appropriate signal, such as an icon, e.g., an arrow or other symbol. This indication of a player's turn may be in addition to the indication on the EPIA 224.

Electronic gaming table 218 may provide a poker game, such as Texas Hold'em for the players. In one embodiment, the provided poker game is a timed game, i.e., each player has a predetermined time period in which to complete each turn. For example, each player has a set period of one minute to complete each turn. Alternatively, the period of time may vary based, e.g., the first turn may have a period of completion of one minute, while the second turn may have a shorter or longer period of completion. Alternatively, each player may have a bank of time. The time used to complete each turn may be deducted from their time bank.

Game engine 582 may include a random number generator or RNG (not shown). At the beginning of each hand of the electronic poker game, the RNG is used to shuffle one or more decks of fifty-two electronic cards and to determine the deck order. One of the players is designated as the dealer. If electronic gaming table 218 is playing Texas Hold'em, the player on the dealer's left (typically designated by the dealer button) is known as the "Little Blind" and the player on the left of the Little Blind is known as the "Big Blind". At the beginning of the hand, the player known as the Big Blind must post into the pot a predetermined amount, e.g., $1, $5, or $10. This amount is also known as the Big Blind. Prior to that, the player known as the Little Blind must also post into the pot a predetermined amount, typically ½ of the Big Blind. This amount is also known as the Little Blind. Typically, the game engine 582 will automatically deduct the Big Blind and the Little Blind from the respective player's stacks and add them to the pot. After the blinds have been posted, the game engine 582 will deal two cards, i.e., the players' hole cards, face down to each player. These cards are displayed face down on each player's electronic player interaction area 224. As described above, each player may controllably view their hole cards. After the hole cards are dealt, the game engine 582 administers a betting round. The first betting round starts with the player on the left of the Big Blind. Generally, each player is given an appropriate set of selections in the form of the game buttons 774. In one embodiment, the game buttons 774 are displayed only during the player's turn. Furthermore, only the game buttons 774 which, according to the rules of the poker game being played, are appropriate are displayed. After the first betting round, three community cards, i.e., the "flop" are dealt face up by the game engine 582 and displayed. In one embodiment, the community cards are displayed in each electronic player interaction area 224, as shown. If a central display area 326 is used, then the community cards may alternatively or in addition be displayed thereon. This is followed by a second betting round. After the second betting round, a fourth community card, i.e. the "turn" is dealt by the game engine 582, followed by a third betting round. After the third betting round, the fifth and final community card, i.e., the "river" is dealt face up. This is followed by the fourth and final betting round. If more than one player remains after the final betting round, the player with the highest hand is determined as the winner of the hand. If after any of the first through third betting rounds, only one player remains, then the remaining player is automatically determined as the winner.

Master gaming server 450 may provide an interface which allows a user, such as an authorized or designated employee of the casino, to set-up or configure or modify the parameters of each electronic gaming table 218. The interface may be implemented on master gaming server 450 or on another device networked to the server 450, such as respective gaming table servers 452. The interface may provide one or more of the following features: ability to turn a table on/off, and ability to change game parameters, such as the permitted wagers, the game being played, the rake, etc.

Table gaming system 210 may track each transaction, wager, card dealt in a database. Table gaming system 210 also may track the players who are playing at each electronic gaming table 218. This information may be saved in a database, summarized, and may be presented in any numerous forms of reporting formats. Any information regarding the player's, the games, and how each hand is played may be tracked. This available data may also be analyzed for purposes of determining the frequency of poker hands (per hour) for a table or all games in which a particular player or players played or detecting, e.g., collusion between players.

Master gaming server 450 may control the advertising displayed on each electronic gaming table 218, such as on central display area 330 or EPIA's 224 and/or remote displays. Master gaming server 450 may also control the content, frequency, and/or the cycling of the advertising.

Table gaming system 210 may include programming to initiate and manage tournament play. For example, in a tournament, a predetermined number of electronic gaming tables 218 having a predetermined number of players are selected. A buy-in, e.g. $100, may be required. Typically, after a player loses all of their money, they are eliminated from the tournament. Under predetermined rules, players may register for a tournament and be assigned to seats at a table. During play, under predetermined rules, tables may be broken down and the players distributed to other tables. Table gaming system 10 may facilitate initiation and management of the tournament by providing one or more of the following features: a) Registration b) Tracking tournament information c) Display of tournament information on central display and/or remote display d) Tournament set-up, e.g., buy-in e) Re buy-in f) Tournament jackpot, cash or entry voucher for entry another tournament (specific tournament or expiration date) g) Process for breaking tables (1) message that table is breaking (2) convey new seat assignment (3) determination of breaking order (4) display of breaking order h) Display information on status of other tables and players at other tables i) System to monitor and adjust hands per hour of an individual table during a tournament: During a poker tournament it is important that each table play roughly the same number of hands per hour as all other tables. This can be accomplished by pausing a game and/or slowing a game down without pausing.

Virtual games may also be provided through EPIAs 224. For example, the virtual or remote games may be played by the poker players when it is not their turn. The virtual or remote games may be another poker hand, played against other players, at the table or at other tables, or played against virtual players. Alternatively, the remote or virtual games may be other types of games, including, but not limited to blackjack, keno, slot machines, etc.

Figure 8A:
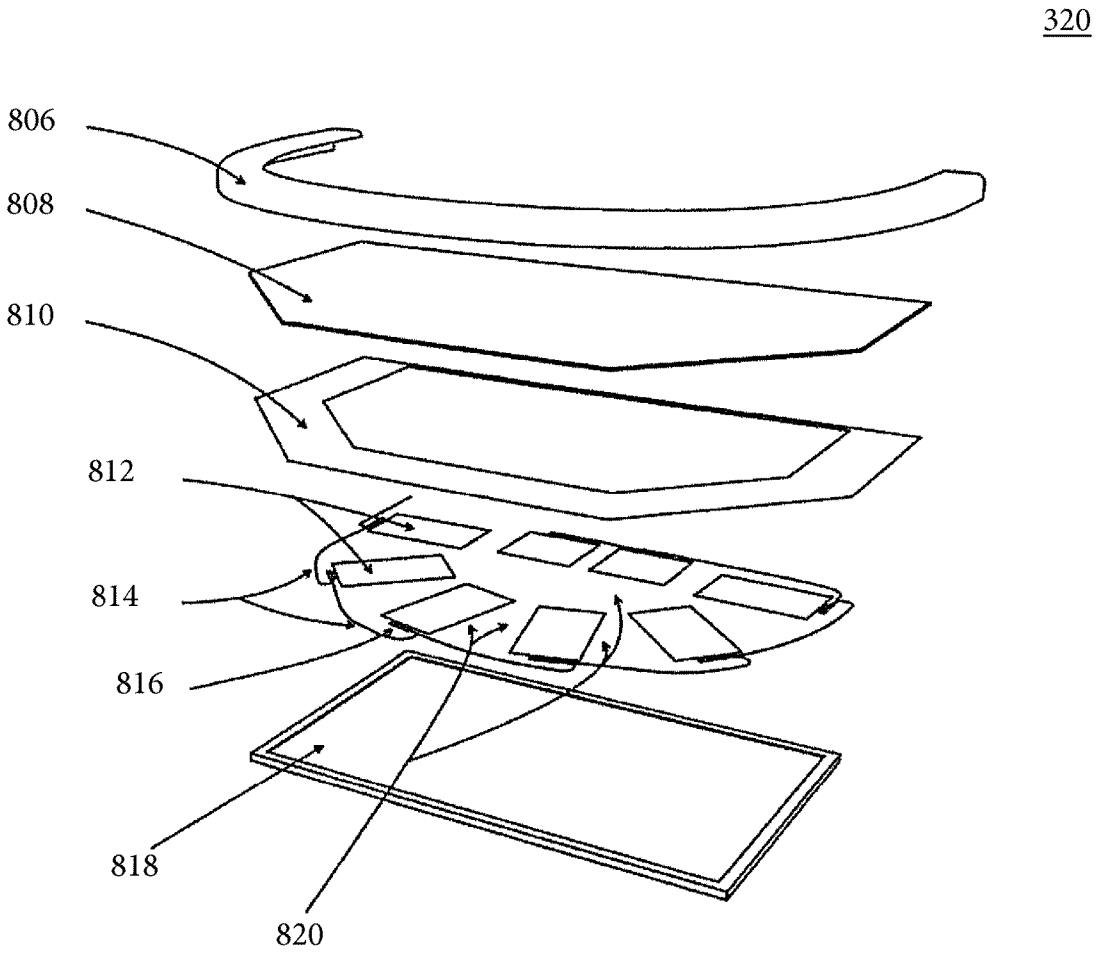
FIG. 8A illustrates a perspective segmented view of an example tabletop of an electronic gaming table within the generic scope of the present technology.

Referring to FIG. 8A, a segmented view is shown of example table top 320 for an electronic gaming table 218 including a plurality of electronic player interaction areas 224 and an electronic dealer interaction area in accordance with the invention. Table top 320 is shown including (in descending order from the uppermost to lowermost segment or section) a rim 806 or railing, a playing surface 808 (that may be a transparent glass or similar substrate), a mask or graphical painted inter-layer 810 (that may be opaque), independent pressure-sensitive touchscreen plates 812, individual touchscreen interconnect leads 814, individual touchscreen circuit boards or controller circuitry (handles I/O ports or logic and communication) 816 and a display screen (LCD or format of display screen may be used) 818. Spaces 820 can be seen separating individual touchscreen plates 812. These spaces 820 may be where the above-mentioned spacers or gaps may be located.

In accordance with the invention, each electronic player interaction area on playing surface 222 may be associated with a respective one of the multiple, independent touchscreen plates 812 which are physically separated from adjacent independent touchscreen plates by a physical separation element (spacers, including open grid spacers or continuous polymer sheets filling the areas between the individual plates) that also lie within the single plane parallel to the continuous, flat, transparent gaming surface 322. Alternatively, each of the multiple, independent touchscreen plates 812 may be separated from adjacent independent touchscreen plates by gaps (open spaces or grid supported open spaces) that also lie within the single plane parallel to the continuous, flat, transparent gaming surface 322.

In one or more embodiments, playing surface 208 may be a continuous, relatively flat, transparent gaming table surface layer. The degree of flatness needed is that which allows pressure to be accurately transmitted from display surface 808 (322 of FIG. 3) to the underlying pressure-sensitive electronic touchscreen plate 812. Playing surface 808 may comprise, where specified, a seamless surface layer (e.g., a single transparent sheet of glass or polymer), but panels of glass or polymer may abut each other to form the flat layer. For example, in one or more embodiments, it may be desirable to design the shape of playing surface 808 so that player interaction areas 224 are inclined at an angle to face towards the players and central display area 330 is elevated to correspond to the upper portion of each player interaction area 224.

In one or more embodiments, it may be preferable for playing surface 808 to be substantially flat, such that all of the multiple, independent touchscreen plates 812 lay within a single plane parallel to the continuous, flat, transparent gaming table surface. One or more alternative embodiments may have slightly different or functionally different height levels of the touchscreen panels across the gaming table surface. For example, an embodiment may have height differentiation between table ends to provide for wheelchair accessibility by having a player interactive area set lower than other areas of the tables. In such case, playing surface 808 may be implemented with multiple display panels or systems, e.g., LCD panels. For example, the middle player interactive areas 224 may be implemented on a single plane, such that in the same plane may lay an image display screen area for displaying game content.

As shown, multiple, independent touchscreen plates 812 are disposed under playing surface 808. Touchscreen plates 812 (as defined herein) are separate plates and are disposed to correspond to player interaction areas 224 and the dealer interaction area. That is, each touchscreen plate 812 is a distinct sub-panel, such as by way of non-limiting examples, a 10×20 cm plate, a 15 by 35 cm plate, a 20×40 cm plate, a 30 by 50 cm plate and the like. One of the benefits of the present technology is the fact that, rather than having a single continuous touchscreen plate underlying playing surface 808 connected by individual area sensitive input/output (I/O) communication links, each player (and dealer) interaction area may include a respective touchscreen plate 812 sized to each player (and dealer) interaction area where player (and dealer) input is to be provided and eliminate or substantially reduce risk of cross-signals being transmitted from one player interaction area to another during game play. Additionally, smaller touchscreen plates, which are frequently the highest cost artificial materials in the system, can be used sparingly to minimize material input and expense in the construction of the tables. A further benefit is that maintenance and table repair costs may be reduced as compared to current electronic gaming table designs, since individual touchscreen plates 812 may be stripped from the underside of the flat transparent gaming surface when a defect arises, rather than having to remove and replace an entire, surface continuous, unitary touchscreen plate.

Communication links 814 connect each of the multiple, independent touchscreen plates 812 to a game server, such as table game server 452 and/or master gaming server 450. Communication links 214 may be hardwired, such as through an electrical lead from the I/O side of each unitary plate to a network; alternatively, wireless connections (e.g., RF) may also be used. The wire connections may be networked or in series or parallel, depending upon the specific communication format, frequencies, amplitudes, etc.

One or more of the multiple, independent touchscreen plates 812 being physically separated from the others. The physical separation of touchscreen plates 812 provides dedicated and separated electronic player interface areas 224. It also results in the use of less area and volume of plates in the construction which result in cost reductions and increased flexibility in design, such as to insert additional structure (e.g. player card or chip RF or optical sensors or readers for reading cards or chips placed on playing surface 808). Preferably each touchscreen plate 812 is physically separate; however, alternative embodiments may associate individual touchscreen plates 812 with two or more player interface areas 812 in which case programming (e.g. virtual firewalls and/or filters) and/or separate communication links 814 may be implemented so that an associated processor (e.g. servers 450, 452) may distinguish signals from one player interface area from another, such as when a signal generated from one player interface area 224 inadvertently is transmitted into another player interface area 224.

Figure 8B:
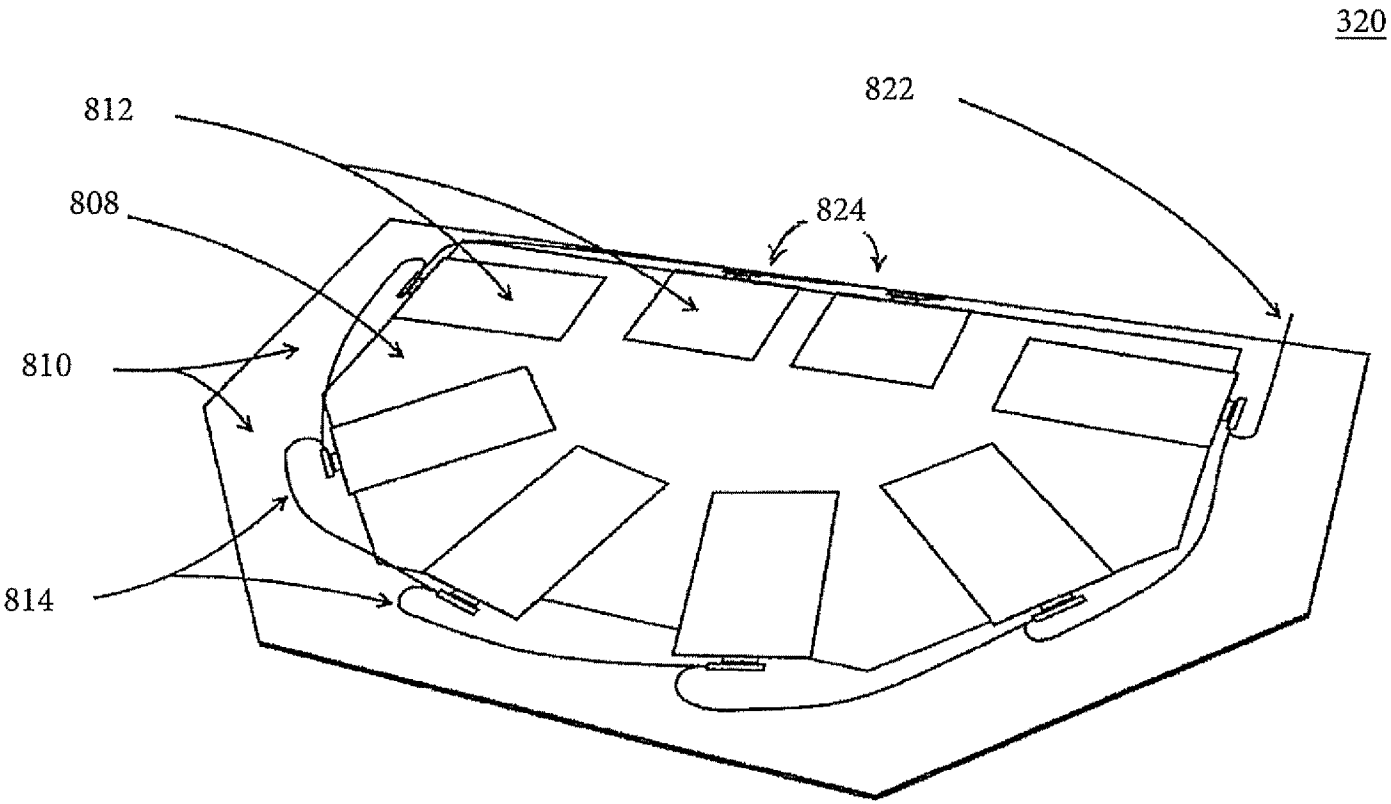
FIG. 8B illustrates a bottom view of individual touchscreen plates and a playing surface within the generic scope of the present technology.

Referring to FIG. 8B, a bottom view of the individual touchscreen plates 812 under the playing surface 808 is shown in accordance with the invention. Input/output (I/O) lead or leads 822 connects each individual plate 812 to a game server (e.g. table game server 452 or master gaming server 450). During operation, touchscreen I/O circuit boards or controller circuitry 816 may receive signals from the touchscreen plates 812 and transmits the signals through I/O leads 814 to I/O terminal 822 which connects to the gaming server.

Signals from the networked touchscreen plates 812 may be individually sent to the game server or may be sent as a single networked signal wherein controllers at each touchscreen plate 812 communicate through the network so that a single packet (with individual identifiers or characters for each touchscreen plate) may be directed from the individual touchscreen plates as a packet transmitted to the game server. The game server can then differentiate between the individual signals and respond accordingly to the signal content (e.g. 'Bet×amount', 'Raise×amount', 'Fold', 'Cash out', etc.)

As shown, electronic gaming table 218 may include a dealer position which may be under exclusive control of the game server or may be completely or partially under control of a live dealer through a dealer position touchscreen panel 824 (FIG. 8A-B) associated with a dealer interface area.

Touch screen technology is well known, so a detailed description is not included herein other than by incorporation by reference. For example, touch sensors are known to be designed and manufactured in various devices and structures. U.S. Pat. No. 7,411,575 (Hill) includes a description of some embodiments and is hereby incorporated by reference. Touch sensors commonly include at least one layer of glass manufactured as part of the sensor (touch plate according to the present definitions herein) that has conductive elements printed on or applied to the front glass at the time of manufacture and the glass acts as the contact surface of the sensor. One type of touch sensor that may be used in the present invention comprises projected-capacitive technology that does not use a glass layer as part of the sensor's construction. For example, playing surface 322 which provides a glass surface layer for game display and player contact surface (top or front of tabletop 320) (e.g. a continuous, flat, transparent table surface) with the transparent sensor assembly attached to the rear (lower) surface of the glass layer.

An example embodiment utilizing projected-capacitive touch sensor contemplates implementation of several layers of polyester film and conductive materials laminated together, with the laminated assembly applied to the lower surface of the glass layer of table top 320 and adhesively secured.

Although specific designs, dimensions and thicknesses have been shown in this description, these are to be considered as exemplary of species within the generic concepts of the present invention and are not to be read as limits on the scope of the generic invention as claimed. Various modifications and variations of the present invention are possible in light of the above teachings within the scope of the invention.

What is claimed:

1. An electronic gaming table comprising:

a continuous, flat, transparent playing surface having a plurality of electronic player interaction areas;

multiple, independent touchscreen plates disposed under the playing surface, each of the touchscreen plates being physically separated from adjacent touchscreen plates;

a display screen for displaying game content, the display screen being disposed under the touchscreen plates; and a graphical painted inter-layer disposed between the playing surface and the touchscreen plates;

wherein each of the touchscreen plates is associated with a respective one of the electronic player interaction areas and each of the touchscreen plates is communicatively connected to a game server.

2. The electronic gaming table as claimed in claim 1, wherein the touchscreen plates lie within a single plane parallel to the playing surface.

3. The electronic gaming table as claimed in claim 2, wherein each of the touchscreen plates are physically separated from adjacent touchscreen plates by a physical separation element that also lies within the single plane parallel to the playing surface.

4. The electronic gaming table as claimed in claim 2, wherein each of the touchscreen plates are physically separated from adjacent touchscreen plates by gaps that also lie within the single plane parallel to the playing surface.

5. The electronic gaming table as claimed in claim 1, wherein the playing surface is a single sheet of glass or polymer.

6. The electronic gaming table as claimed in claim 1, wherein the touchscreen plates are connected in series to the game server.

7. The electronic gaming table as claimed in claim 1, wherein the touchscreen plates are connected in parallel to the game server.

8. The electronic gaming table as claimed in claim 1, wherein the playing surface further includes an electronic dealer interaction area with a corresponding independent touchscreen plate which is communicatively connected to the game server.

9. The electronic gaming table as claimed in claim 1, further including a dealer position gaming event display area under exclusive control of the game server.

10. A method of playing a wagering game using the electronic gaming table as claimed in claim 1, the method comprising entering game play instructions on the independent touchscreen plates to enter game play instructions to the game server.

* * * * *